United States Patent [19]

Asanomi et al.

[11] 4,164,205

[45] Aug. 14, 1979

[54] INTERNAL COMBUSTION ENGINE HAVING A DUAL INDUCTION TYPE INTAKE SYSTEM

[75] Inventors: Koji Asanomi; Yasunori Takemoto; Kazuo Kobayashi, all of Hiroshima, Japan

[73] Assignee: Toyo Kogyo Co., Ltd., Hiroshima, Japan

[21] Appl. No.: 857,515

[22] Filed: Dec. 5, 1977

[30] Foreign Application Priority Data

Dec. 10, 1976 [JP] Japan ..... 51/149282
Dec. 10, 1976 [JP] Japan ..... 51/149283

[51] Int. Cl.[2] ..... F02P 5/04
[52] U.S. Cl. ..... 123/117 R; 123/117 A
[58] Field of Search ..... 123/117 A, 117 R, 127, 123/32 ST

[56] References Cited

U.S. PATENT DOCUMENTS

| | | | |
|---|---|---|---|
| 2,621,911 | 12/1952 | Lindsteadt | 261/41 |
| 3,353,524 | 11/1967 | Sarto | 123/117 |
| 3,408,992 | 11/1968 | Von Seggern et al. | 123/75 |
| 3,418,981 | 12/1968 | Von Seggern et al. | 123/75 |
| 3,554,173 | 1/1971 | Masaki et al. | 123/119 |
| 3,561,410 | 2/1971 | Soeters | 123/117 |
| 3,678,905 | 7/1972 | Diehl | 123/52 M |
| 3,704,702 | 12/1972 | Aono | 123/179 G |
| 3,788,291 | 1/1974 | Wu | 123/117 A |
| 3,852,379 | 12/1974 | Shishido et al. | 123/32 ST |

*Primary Examiner*—Edgar W. Geoghegan
*Attorney, Agent, or Firm*—Fleit & Jacobson

[57] ABSTRACT

Internal combustion engine having an intake port formed in cylinder head and first and second intake passages both connected with the intake port. The intake passages are respectively provided with throttle valves and the throttle valve in the second intake passage is opened only under a heavy load operation. The ignition timing is advanced or an additional supply of fuel is provided in the transient period wherein the throttle valve in the first intake passage has reached substantially fully open position and the throttle valve in the second intake passage has started to open so as to supplement any decrease in the engine output in this period.

6 Claims, 6 Drawing Figures

INTERNAL COMBUSTION ENGINE HAVING A DUAL INDUCTION TYPE INTAKE SYSTEM

The present invention relates to internal combustion engines and more particularly to intake systems for such engines. More specifically, the present invention pertains to internal combustion engines having dual induction type intake systems.

Hithertofore, it has already been proposed to provide an internal combustion engine with an intake system comprising a single intake port and two separated intake passages communicating with the intake port. The first one of the intake passages has a comparatively small cross-sectional area while the second one has a comparatively large cross-sectional area. Both of the passages have throttle valves respectively and the throttle valve in the second passage is opened only during a heavy load operation of the engine. Such intake systems may be referred to as "dual induction" type and examples of such systems may be found in the U.S. Pat. Nos. 3,408,992; 3,418,981 and 3,678,905.

This type of intake system has been found advantageous in that atomization and vaporization of fuel can be enhanced under light and medium load operations because air or air-fuel mixture is passed only through the relatively narrow intake passage at a high speed. Further, under heavy load operation, additional charge is supplied on demand through the relatively large second passage so as to provide a desired engine output. It has also been recognized in this type of intake system that an improved combustion mixture can be achieved in the combustion chamber where the intake port is so designed that the kinetic energy of the intake flow can be effectively utilized to produce an intense swirl in the combustion chamber as, for example, discussed in copending U.S. Pat. application Ser. No. 840,365 which has been filed on Oct. 7, 1977 claiming the convention priority based on Japanese patent application Sho 51-121531 filed on Oct. 9, 1976 and on Japanese Utility Model application Sho 51-175089 filed on Dec. 24, 1976 and has been assigned to the assignee of this application.

In the aforementioned dual induction type intake system, however, it has been experienced that the engine output is decreased in the transient operating zone wherein the throttle valve in the first passage reaches the substantially full open position and that in the second passage begins to open. This is understood as being caused due to the fact that the first intake passage for light load engine operation has a cross-sectional area which is small in relation to the cross-sectional area of a conventional intake passage in order to accomplish an improved atomization and vaporization of fuel and/or produce an intense swirl in the combustion chamber under light and medium load operation, so that the flow speed of the intake fluid significantly increases in accordance with an increase in the engine speed. Such increased flow speed causes an increase in the flow resistance and the increased flow resistance will in turn decrease the charging efficiency of the engine. Thus, the amount of the residual combustion gas is increased with respect to the amount of fresh charge of mixture particularly in the transient operating zone causing a decrease in the engine output.

The present invention has therefore an object to provide an internal combustion engine which has a dual induction type intake system but does not show any decrease in the engine output in the transient operating zone.

Another object of the present invention is to provide an internal combustion engine in which means is provided for increasing the engine output during the transient operating zone.

A further object of the present invention is to provide an internal combustion engine in which the engine output increases smoothly from medium load operation to heavy load operation.

According to the present invention, in order to accomplish the above and other objects, there is provided an internal combustion engine comprising cylinder means, piston means disposed in said cylinder means for defining therein combustion chamber means of variable volume, intake port means provided in said cylinder means and opening to said combustion chamber means, first and second intake passage means connected with said intake port means, first and second throttle valve means respectively provided in said first and second intake passage means, means for actuating said first and second throttle valve means so that the second throttle valve means starts to open after the first throttle valve means has been substantially fully opened, means for increasing engine output on demand, means for sensing that the first throttle valve means is in the vicinity of the substantially full open position and producing a transient signal, means for receiving said transient signal and actuating the engine output increasing means. Thus according to the present invention, it is possible to compensate for a decrease in the engine output which may otherwise be experienced during the transient operating zone wherein the first throttle valve means has approached the substantially full open position and the second throttle valve means starts to open.

According to a preferable aspect of the present invention, the sensing means is constituted by means for detecting a difference in pressure in the first intake passage means and that in the second intake passage means. More specifically, the pressure in the first intake passage means near the downstream side of the first throttle valve means may be compared with the pressure in the second intake passage means. The engine output increasing means may be constituted by means for advancing ignition timing. Alternatively, the engine output increasing means may comprise means for providing an additional supply of fuel or cutting-off one or more accessories that may cause decrease in engine output.

The above and other objects and features of the present invention will become apparent from the following descriptions of preferred embodiments making reference to the accompanying drawings, in which.

Figure 1:
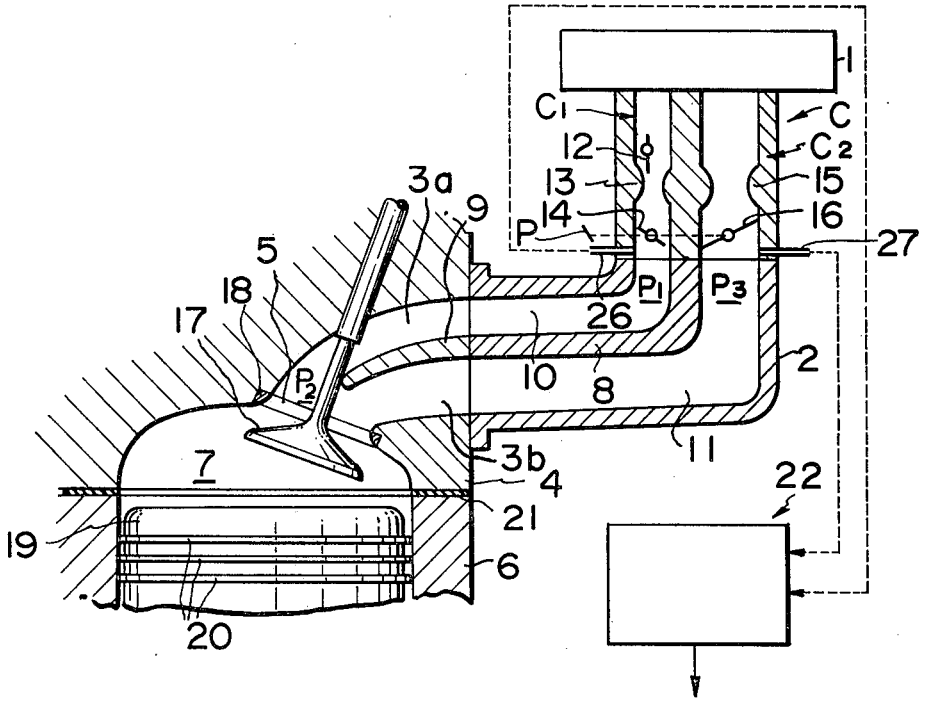
FIG. 1 is a diagrammatical sectional view of an internal combustion engine in which the present invention can be embodied.

Referring now to the drawings, particularly to FIG. 1, the internal combustion engine shown therein includes a cylinder 6 having a cylinder head 4 secured thereto with an intervention of gasket 21. A piston 19 having piston rings 20 is disposed in the cylinder 6 to define a combustion chamber 7. The cylinder head 4 is formed with an intake port 5 which is in communication with passages 3*a* and 3*b* separated by a wall 9.

The engine has an intake system including an air cleaner 1 and a carburetor assembly C which includes a first carburetor $C_1$ and a second carburetor $C_2$. The first carburetor $C_1$ includes a choke valve 12, a first venturi 13 and a first throttle valve 14. The second carburetor $C_2$ includes a second venturi 15 and a second throttle valve 16. The carburetor assembly C is connected with an intake manifold 2 which is in turn connected with the cylinder head 4. The intake manifold 2 has a first intake passage 10 and a second intake passage 11 which are separated by a wall 8. The first intake passage 10 is connected at one end with the first carburetor $C_1$ and at the other end with the passage 3*a* in the cylinder head 4. Similarly, the second intake passage 11 is connected at one end with the second carburetor $C_2$ and at the other end with the passage 3*b*.

The first intake passage 10 has a cross-sectional area which is small in relation to that of the second intake passage 11. The throttle valves 14 and 16 are associated with a throttle actuating mechanism P which serves to open the second throttle valve 16 when the first throttle valve 14 has reached a wide-open position, preferably a full open position, and the engine speed is above a predetermined value. For the purpose, a pneumatically operated throttle valve actuator may be provided for the second throttle valve 16.

The intake port 5 in the cylinder head 4 is provided with a valve seat 18 and an intake valve 17 is provided for co-operation with the valve seat 18. A suction pressure conduit 26 opens at one end to the first intake passage 10 in the vicinity of but on the downstream side of the first throttle valve 14. Similarly, a suction pressure conduit 27 opens at one end to the second intake passage 11 at the downstream side of the second throttle valve 16. The other end of the conduits 26 and 27 are connected with a pneumatic actuator 22.

Figure 4:
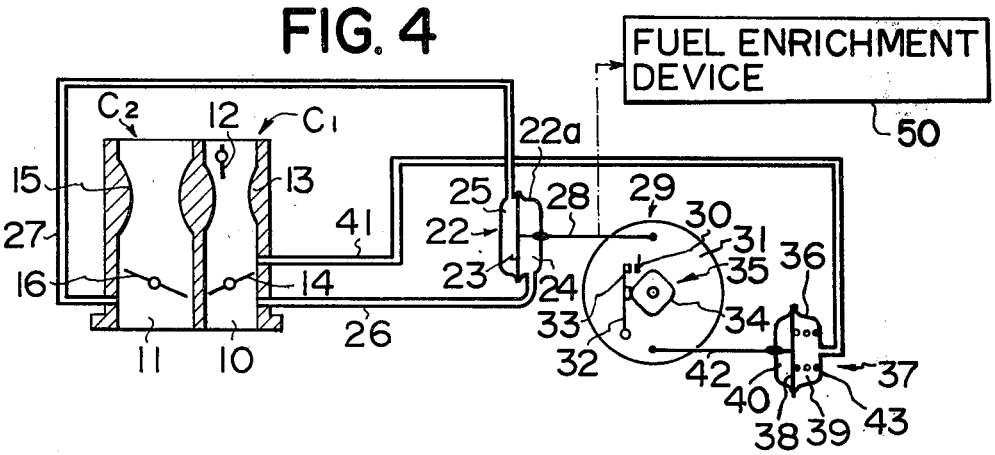
FIG. 4 is a diagrammatical view showing the engine output control system in accordance with one embodiment of the present invention.

Referring now to FIG. 4, the pneumatic actuator 22 comprises a casing 22*a* in which a diaphragm 23 is disposed for dividing the inside of the casing 22*a* into a first chamber 24 and a second chamber 25 which are respectively connected with the conduits 26 and 27 leading from the first and second intake passages 10 and 11, respectively. The diaphragm 23 is connected with a push-pull rod 28 which is in turn connected with an ignition timing control device 29.

The device 29 may include a disc 31 carrying a stationary contact 30 and a movable contact 33 which is provided at one end of a contact arm 32 mounted at the other end on the disc 31. A breaker cam 34 of a breaker assembly 35 engages the arm 32 so as to cyclically bring the movable contact 33 out of engagement with the stationary contact 30. The connection between the rod 28 and the disc 31 is such that, when the suction pressure in the chamber 25 increases with respect to that in the chamber 24, the disc 31 is rotated in such counterclockwise direction wherein the ignition timing is advanced.

The device 29 shown in FIG. 4 is further associated with a suction type ignition timing advancer 37 which includes a casing 36 having a diaphragm 38 dividing the inside of the casing 36 into a suction pressure chamber 39 and an atmospheric pressure chamber 40. The chamber 39 is connected through a conduit 41 with the first intake passage 10. The diaphragm 38 has a push-pull rod 42 which is connected with the disc 31. In the chamber 39, there is disposed a compression spring 43 which urges the diaphragm 38 against the action of the suction pressure in the chamber 39. Such type of control of the ignition timing is well known in the art and disclosed for example by the U.S. Pat. Nos. 3,353,524 and 3,561,410. Therefore, detailed descriptions of the control will not be made.

Figure 3:
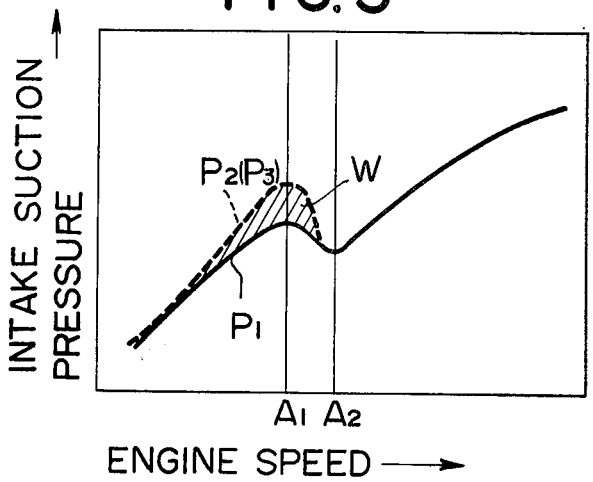
FIG. 3 is a diagram showing the change in the intake suction pressure.

In operation, the first throttle valve 14 in the passage 10 is opened during light and medium load engine operations while the second throttle valve 16 is closed. Since the first intake passage 10 is of comparatively small cross-sectional area, there is a pressure drop in the passage 10, which increases in accordance with an increase in the flow speed. Referring now to FIG. 3 which shows the change in the intake suction pressures with the first throttle valve 14 in the full open position, it will be noted in this dual induction type intake system that the suction pressure $P_1$ at the immediately downstream side of the first throttle valve 14 increases in accordance with an increase in the engine speed more slowly than the increase of the suction pressure $P_2$ at the first intake passage 10 in the vicinity of the intake port 5. In other words, the absolute pressure is higher at the immediately downstream side of the first throttle valve 14 than at the position near the intake port 5 due to the influence of the pressure drop in the passage 10. The suction pressure $P_3$ in the second intake passage 11 can be considered as being substantially identical to the suction pressure $P_2$ as long as the second throttle valve 16 is closed.

Where the engine speed is comparatively low, the difference between the suction pressures $P_1$ and $P_2$ is not so significant but as the engine speed increases the pressure drop in the first intake passage increases to such an extent that a substantial difference is produced between the suction pressures $P_1$ and $P_2$. As the engine speed increases beyond a value $A_1$ where the second throttle valve 16 starts to open, the flow speed in the first intake passage 10 is decreased since a part of the intake mixture is allowed to flow through the second intake passage 11 whereby the pressure drop along the first intake passage 10 is correspondingly decreased. As a result, the difference between the suction pressures $P_1$ and $P_2$ or $P_3$ is gradually decreased as shown by W in FIG. 3 until the engine gets a speed $A_2$ wherein the second throttle valve 16 is fully opened and both pressures finally reach substantially the same value. Thereafter, the suction pressures $P_1$ and $P_2$ or $P_3$ simultaneously increase in accordance with an increase in engine speed. Thus, it will be noted in FIG. 3 that the difference in pressures $P_1$ and $P_2$ or $P_3$ is significant in the transient operating zone, that is, immediately before and after the second throttle valve 16 starts to open.

Figure 2:
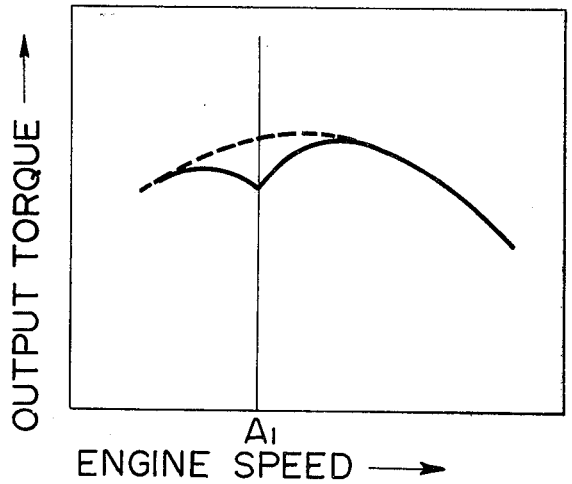
FIG. 2 is a diagram showing the change in the engine output torque in accordance with the change in the engine speed.

Referring now to FIG. 2 which shows the change in the engine output torque with the first throttle valve 14 fully opened, there is a significant decrease in the engine output torque around the engine speed $A_1$ where the second throttle valve 16 starts to open. It is understood that the increased flow speed in the first intake passage 10 causes an increase in the flow resistance and the charging efficiency is correspondingly decreased. As a result, the rate of the residual combustion gas increases with respect to the fresh charge of air-fuel mixture causing a decrease in the engine output torque in this operating zone.

Figure 5:
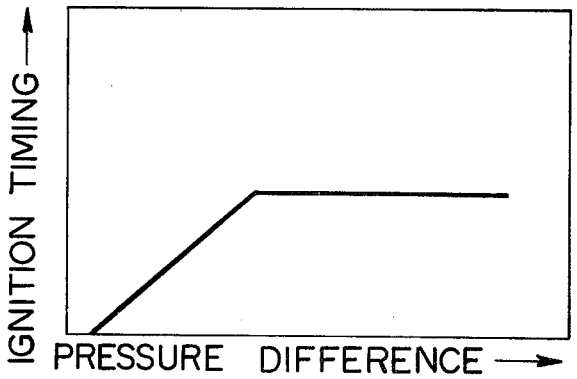
FIG. 5 is a diagram showing the ignition timing control in accordance with one embodiment of the present invention.

According to the aforementioned arrangement embodying the feature of the present invention, however, the pressure $P_1$ and the pressure $P_3$ are introduced respectively through the conduits 26 and 27 into the chambers 24 and 25 in the pneumatic actuator 22 so that the diaphragm 23 is moved leftwards as seen in FIG. 4 under the pressure difference existing in the transient zone thus rotating the disc 31 counterclockwise to advance the ignition timing. The ignition timing is advanced in such a manner that as soon as the pressure difference reaches a predetermined value the timing is gradually advanced in accordance with a further increase in the pressure difference and then maintained at a constant value irrespective of further increase in the pressure difference as shown in FIG. 5. Thus, the engine output is increased to compensate for the possible engine output decrease in the transient operating zone to accomplish a smooth change in the output torque as shown by the broken line in FIG. 2. It should of course be noted that the aforementioned control of the ignition timing is performed in addition to the control carried out by the suction device 37.

Figure 6:
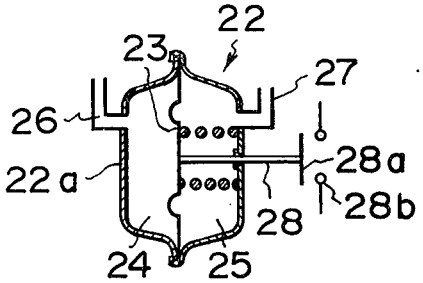
FIG. 6 is a sectional view diagrammatically showing the pressure difference detecting means in accordance with another embodiment of the present invention.

FIG. 6 shows another embodiment of the present invention wherein the pneumatic actuator is constituted in the same manner as in the previous embodiment so that corresponding parts are shown by the same reference numerals. In this embodiment, the rod 28 connected with the diaphragm 23 has a switch contact **28*a* at the outer end which co-operates with stationary switch contacts 28*b***.

In the previous embodiments, the transient operating zone is detected by means of a diaphragm for sensing the pressure difference between the first and second intake passages, however, it should be noted that it is within the scope of the present invention to employ any other means for detecting the transient zone. For example, mechanical or electrical means may be used to detect the engine speed or the position of the throttle valves.

Further, in order to compensate for the decrease in the engine output, any other means may be employed in addition to or in the place of the ignition timing control device. For example, a fuel enrichment device 50 as shown in FIG. 4 may be employed to provide an additional supply of fuel in the transient operating zone. Such device 50 may be of such a type disclosed by anyone of the U.S. Pat. Nos. 2,621,911; 3,554,173 and 3,704,702.

The invention has thus been shown and described with reference to specific embodiments, however, it should be noted that the invention is in no way limited to the details of the illustrated arrangements but changes and modifications may be made without departing from the scope of the appended claims. For example, the engine output increasing means may be operated only during a part of the transient zone operation, such as only before or only after the second throttle valve starts to open.

We claim:

1. Internal combustion engine comprising cylinder means, piston means disposed in said cylinder means for defining therein combustion chamber means of variable volume, intake port means provided in said cylinder means and opening to said combustion chamber means, first and second intake passage means connected with said intake port means, first and second throttle valve means respectively provided in said first and second intake passage means, means for actuating said first and second throttle valve means so that the second throttle valve means starts to open after the first throttle valve means has been substantially fully opened, means for increasing engine output on demand, means for sensing that the first throttle valve means is in the vicinity of a substantially full open position and producing a transient signal, means for receiving said transient signal and actuating the engine output increasing means.

2. Engine in accordance with claim 1 in which said sensing means includes means for detecting a difference in pressure in the first intake passage means and that in the second intake passage means.

3. Engine in accordance with claim 2 in which said actuating means is a pneumatic actuator means operated in accordance with said pressure difference and directly actuating said engine output increasing means.

4. Engine in accordance with claim 2 in which said actuating means is a pneumatic means operated in accordance with said pressure difference and having electric switch means for actuating said engine output increasing means through electric power.

5. Engine in accordance with claim 1 in which said engine output increasing means is a means for advancing ignition timing to increase the engine output.

6. Engine in accordance with claim 1 in which said engine output increasing means is a means for providing additional supply of fuel.

* * * * *